US005856249A

United States Patent [19]

Waldrop et al.

[11] Patent Number: 5,856,249

[45] Date of Patent: Jan. 5, 1999

[54] ULTRAVIOLET RESISTANT FABRIC

[75] Inventors: Anthony R. Waldrop, Easley; Steven W. Josey, Moore; Gettys H. Knox, Union, all of S.C.

[73] Assignee: Milliken Research Corporation, Spartanburg, S.C.

[21] Appl. No.: 3,560

[22] Filed: Jan. 6, 1998

Related U.S. Application Data

[63] Continuation-in-part of Ser. No. 863,974, May 27, 1997, Pat. No. 5,807,794, which is a continuation-in-part of Ser. No. 630,381, Apr. 10, 1996, Pat. No. 5,632,526, which is a continuation of Ser. No. 337,260, Nov. 10, 1994, Pat. No. 5,533,789.

[51] Int. Cl.[6] ..... D03D 15/08

[52] U.S. Cl. ..... 442/184; 139/383 R; 139/421; 442/199; 442/203

[58] Field of Search ..... 139/383 R, 421; 442/184, 199, 203

*Primary Examiner*—James J. Bell

*Attorney, Agent, or Firm*—Terry T. Moyer; James M. Robertson

[57] ABSTRACT

A fabric resistant to degradation of strength and elastomeric properties upon exposure to ultraviolet irradiation is provided. The fabric includes an elastomeric fiber component which makes up not less than 40 percent by weight of the fabric. This elastomeric fiber component exhibits a tensile strength of not less than about 8 pounds force and retains at least 80 percent of its tensile strength following accelerated exposure to ultraviolet irradiation.

17 Claims, No Drawings

ULTRAVIOLET RESISTANT FABRIC

This application is a continuation-in-part of U.S. application Ser. No. 08/863,974 filed May 27,1997 now U.S. Pat. No. 5,807,794 which is a continuation-in-part of U.S. application Ser. No. 08/630,381 filed Apr. 10,1996 (U.S. Pat. No. 5,632,526) which is a continuation of U.S. application Ser. No. 08/337,260 filed Nov. 10,1994 (U.S. Pat. No. 5,533,789) all of which are incorporated herein by reference.

FIELD OF THE INVENTION

This invention relates generally to upholstery fabrics and relates more particularly to elastomeric upholstery fabrics possessing resistance to ultraviolet irradiation.

BACKGROUND

Upholstery fabrics which are used in automotive applications are exposed to substantial amounts of ultraviolet irradiation due to the intrusion of sunlight into the automotive interior through the wind screen, windows and other viewing surfaces which are necessary to permit operation of the vehicle. While fading and other aesthetic degradation arising from such ultraviolet exposure has been dealt with primarily through the development of improved dyeing practices and materials, strength degradation of the fabrics arising from ultraviolet exposure has remained a substantial issue. This issue is becoming increasingly important as consumer expectations regarding the long term performance of such fabrics continues to grow.

Materials useful in the construction of previous fabrics for automotive interior applications have generally been synthetic woven materials as are well know in the art. The use of synthetic orientated thermoplastic elastomers in support members for automotive seats has been proposed in U.S. Pat. No. 4,469,738 to Himelreich, Jr. and U.S. Pat. No. 4,469,739 to Gretzinger et al. (both incorporated by reference). Although such elastomeric materials were previously available it is believed that such materials lacked sufficient ultraviolet stability to be used in surface fabrics. Hence, it is understood that such materials were designated primarily for use as underlying support materials when used in automotive seating applications. The present invention provides a textile structure which incorporates elastomeric components which are substantially resistant to ultraviolet irradiation and thus do not undergo substantial strength reduction upon prolonged exposure to such irradiation. The fabric thus produced is thereby suitable for use as a surface material in automotive seating applications and thereby represents a useful advancement over the state of the art.

OBJECTS AND SUMMARY OF THE INVENTION

In light of the foregoing, it is a general object of the present invention to provide a textile structure incorporating yarns of elastomeric character which textile structure is suitable for use as an automotive upholstery fabric.

It is a more particular object of the present invention to provide a textile structure of elastomeric character which exhibits good strength stability upon exposure to ultraviolet irradiation.

It is a further object of the present invention to provide a woven fabric including elastomeric fiber disposed in either the warp or the fill direction which fabric retains not less than about 80 percent of its breaking strength when measured in the elastomeric fiber direction and not less than about 65 percent of its breaking strength when measured perpendicular to the elastomeric fiber direction following exposure of such fabric to standard ultraviolet irradiation test levels of 488 kilojoules.

Additional objects and features of the present invention will become apparent upon reading the following detailed description. While the invention will be described in connection with certain preferred embodiments and procedures, it is, of course, to be appreciated that there is no intention to limit the invention to such particularly described embodiments and procedures. On the contrary, it is intended to include all alternatives modifications and equivalents as may be included within the true spirit and scope of the invention.

DESCRIPTION OF PREFERRED EMBODIMENTS

According to the preferred embodiment, the fabric according to the present invention is a woven fabric and most preferably a barathea weave. This fabric is preferably formed using a monofilament, ultraviolet stable, polyester warp yarn marketed by Hoechst Celanese Corporation under the trade designation ELAS-TER™ monofilament. In one potentially preferred embodiment, this warp yarn is a bicomponent sheath/core yarn wherein the sheath component is characterized by a melting point which is at least 30° F. below the melting point of the core component.

The warp yarn is preferably interwoven with a fill yarn of Taslan airjet textured polyester having an ELAS-TER™ base which may or may not be stabilized against ultraviolet irradiation. The result of this structure is that the elastomeric monofilament polyester in the warp provides the overall fabric structure with elastic performance and ultraviolet stability while the Taslan yarn with its elastomeric base component disposed in the fill direction provides the fabric with desirable aesthetic and tactile features.

In the potentially preferred embodiment of the present invention, the warp yarn is a 2250 denier elastomeric monofilament polyester disposed in the fabric at a weave density of about 20 ends per inch. The fill yarn is most preferably a 1860 denier Taslan polyester with elastomeric base yielding an actual denier of about 2200 disposed in the fabric at a weave density of about 20 picks per inch. One source for the Taslan polyester fill yarn is Grover Industries which is believed to have a place of business at Grover N.C., USA.

As previously indicated, a fundamental feature according to the present invention is retention of both tensile strength and elongation characteristics subsequent to exposure to high levels of ultraviolet radiation. The industry standard is to evaluate such properties after exposure to a cumulative irradiation of 488 kilojoules in accordance with SAE Standard J1885. It is believed that fabrics according to the present invention exhibiting substantially improved retention in strength and elastomeric performance are obtained when they incorporate elastomeric synthetic yarns running in at least one direction and when such yarns make up not less than about 40% by weight of the total textile fabric, have an elongation at break of not less than about 70% before and after exposure to accelerated levels of ultraviolet irradiation and retain not less than about 80% of their tensile strength after exposure to accelerated levels of ultraviolet irradiation. In a potentially more preferred embodiment such elastomeric synthetic yarns are characterized by an elongation at break of not less than about 85% before and after exposure to accelerated levels of ultraviolet irradiation and retain not less than about 90% of their tensile strength upon exposure to accelerated irradiation. In a potentially most preferred embodiment, the elastomeric synthetic yarns will be characterized by an elongation at break of not less than about 95% before and after exposure to accelerated levels of ultraviolet irradiation and will retain not less than about 95% of their original tensile strength following exposure to accelerated irradiation at a level of about 488 kilojoules.

The invention may be further understood and appreciated by reference to the following examples which are not to be construed as unduly limiting the invention, but are rather provided to facilitate an understanding thereof.

EXAMPLE 1

A woven elastomeric automotive upholstery was formed in a barathea weave on a standard rapier weaving machine utilizing a reed width of 69 inches, a beam width of 68 inches, and a 4 harness configuration. The warp yarn was a 1/2250 elastomeric monofilament UV-stable ELAS-TER™ polyester from Hoechst Celanese. The fill yarn was a 1860 denier Taslan polyester with ELAS-TER™ base (2220 actual denier) textured by Grover Industries in Grover, N.C. The machine weave density was 20 ends per inch X 20 picks per inch. The warp yarn exhibited a tensile strength of approximately 8.9 pounds force and an elongation at break of about 124% as tested before weaving. A sample of the warp yarn exposed to accelerated ultraviolet irradiation at a level of 488 kilojoules in compliance with SAE testing standard J1885 exhibited a tensile strength of 7.1 pounds force and an elongation at break of approximately 115%.

The fabric formed (designated by style# 957044) was heatset at 395° F. and was thereafter measured to have an average tensile strength in the warp direction of about 126.8 pounds force per inch prior to ultraviolet irradiation and about 107.5 pounds force per inch subsequent to 488 kilojoules of ultraviolet irradiation. The fabric was measured to have an average tensile strength of about 64.3 pounds force per inch in the weft direction as formed which decreased to about 44.7 pounds force per inch following accelerated exposure to 488 kilojoules ultraviolet irradiation. All tensile strengths were measured according to ASTM D412.

EXAMPLE 2

(prophetic)

The procedures of Example 1 are carried out in all respects except that the warp yarn is a 2250 denier elastomeric monofilament UV-stable ELAS-TER™ polyester from Hoechst Celanese which exhibits a tensile strength of approximately 9.1 pounds force and an elongation at break of about 107 percent as tested before weaving and 8.9 pounds force with an elongation at break of 97 percent following exposure to 488 kilojoules in compliance with SAE testing standard J1885.

While the preferred embodiments of the invention have been described in the description and examples set forth above. Such description has been for illustrative purposes only and it is to be understood that changes and variations may be made without departing from the spirit and scope and invention which is defined and limited only by the allowable claims and equivalents thereto.

What is claimed is:

1. A textile fabric formed from synthetic yarns and exhibiting resistance to strength degradation due to ultraviolet irradiation, said fabric comprising: a plurality of elastomeric synthetic yarns running in a first direction interwoven with a plurality of synthetic yarns running in a second direction substantially transverse to said first direction, wherein said elastomeric synthetic yarns running in said first direction comprise not less than about 40 percent by weight of said textile fabric; are characterized by an elongation at break of not less than about 50 percent; and retain not less than about 80 percent of their tensile strength upon accelerated exposure to 488 kilojoules of ultraviolet irradiation.

2. The textile fabric as in claim 1, wherein said elastomeric synthetic yarns running in said first direction are biocomponent sheath/core elastomeric yarns having a sheath component characterized by a melting point which is at least 30° F. below the melting point of said core component.

3. The textile fabric as in claim 1, wherein the elastomeric synthetic yarns running in said first direction are interwoven with the synthetic yarns running in said second direction by means of a barathea weave.

4. The textile fabric as in claim 1, wherein the elastomeric synthetic yarns running in said first direction are interwoven with the synthetic yarns running in said second direction by means of a twill weave.

5. The textile fabric as in claim 1, wherein the elastomeric synthetic yarns running in said first direction are interwoven with the synthetic yarns running in said second direction by means of a dobby weave.

6. The invention as in claim 1, wherein said synthetic yarns running in said second direction comprise an elastomeric monofilament.

7. The invention as in claim 6, wherein said elastomeric monofilament is surrounded by an aesthetic fiber covering.

8. The invention as in claim 1 wherein said synthetic yarns running in said second direction comprise an elastomeric monofilament which retains not less than about 80 percent of its tensile strength following accelerated exposure to 488 kilojoules of ultraviolet irradiation.

9. The invention as in claim 1, wherein said elastomeric synthetic yarns running in said first direction are further characterized by having a tensile strength of not less than about 8 pounds force prior to weaving.

10. The invention as in claim 1, wherein said elastomeric synthetic yarns running in said first direction retain not less than about 90 percent of their tensile strength upon accelerated exposure to 488 kilojoules of ultraviolet irradiation.

11. The invention as in claim 1, wherein said elastomeric synthetic yarns running in said first direction retain not less than about 95 percent of their tensile strength upon accelerated exposure to 488 kilojoules of ultraviolet irradiation.

12. A textile fabric formed from synthetic yarns and exhibiting resistance to strength degradation due to ultraviolet irradiation, said fabric comprising: a plurality of elastomeric synthetic yarns running in a first direction interwoven with a plurality of synthetic yarns running in a second direction substantially transverse to said first direction, wherein said elastomeric synthetic yarns running in said first direction comprise not less than about 40 percent by weight of said textile fabric; are characterized by an elongation at break of not less than about 70 percent; and retain not less than about 80 percent of their tensile strength upon accelerated exposure to 488 kilojoules of ultraviolet irradiation.

13. The invention as in claim 12, wherein said elastomeric synthetic yarns running in said first direction retain not less than about 90 percent of their tensile strength upon accelerated exposure to 488 kilojoules of ultraviolet irradiation.

14. The invention as in claim 12, wherein said elastomeric synthetic yarns running in said first direction retain not less than about 95 percent of their tensile strength upon accelerated exposure to 488 kilojoules of ultraviolet irradiation.

15. The invention as in claim 12, wherein said elastomeric synthetic yarns running in said first direction are further characterized by having a tensile strength of not less than about 8 pounds force prior to weaving.

16. A textile fabric formed from synthetic yarns and exhibiting resistance to strength degradation due to ultraviolet irradiation, said fabric comprising: a plurality of elastomeric synthetic yarns running in a first direction interwoven with a plurality of synthetic yarns running in a second direction substantially transverse to said first direction, wherein said elastomeric synthetic yarns running in said first direction comprise not less than about 40 percent by weight of said textile fabric; are characterized by an elongation at break of not less than about 90 percent; and retain not less than about 90 percent of their tensile strength upon accelerated exposure to 488 kilojoules of ultraviolet irradiation.

17. The invention as in claim 15, wherein said elastomeric synthetic yarns running in said first direction are further characterized by having a tensile strength of not less than about 8 pounds force prior to weaving.

* * * * *